United States Patent [19]

Van Doorselaer et al.

[11] 4,049,454

[45] Sept. 20, 1977

[54] COLOR RADIOGRAPHY

[75] Inventors: Marcel Karel Van Doorselaer, Gravenwezel; Romain Henri Bollen, Hove, both of Belgium

[73] Assignee: AGFA-GEVAERT N.V., Mortsel, Belgium

[21] Appl. No.: 607,937

[22] Filed: Aug. 26, 1975

[30] Foreign Application Priority Data

Sept. 3, 1974 United Kingdom ..... 38487/74

[51] Int. Cl.[2] ..... G03C 7/00; G03C 1/76; G03C 1/92

[52] U.S. Cl. ..... 96/55; 96/68; 96/82

[58] Field of Search ..... 96/55, 56.5, 22, 74, 96/68, 82

[56] References Cited

U.S. PATENT DOCUMENTS

| | | | |
|---|---|---|---|
| 3,114,833 | 12/1963 | Fine | 96/74 |
| 3,546,128 | 12/1970 | Rabatin | 252/301.4 |
| 3,725,704 | 4/1973 | Buchanan et al. | 250/484 |
| 3,734,735 | 5/1973 | Bories | 96/56.5 |

*Primary Examiner*—Mary F. Kelley
*Attorney, Agent, or Firm*—A. W. Breiner

[57] ABSTRACT

A photographic material suited for forming color radiographs, which material comprises on both sides of a film support at least one silver halide emulsion layer incorporating at least one color coupler that is capable of forming with an oxidized p-phenylenediamine type color developing agent a dye, said color coupler(s) being present in an amount sufficient to allow by exposure and color development with a p-phenylene diamine type developing agent to obtain a spectral density in the material of at least 2.0 with respect to visual filter light, the aggregate amount of silver halide in said material being equivalent to an amount of silver nitrate in the range of 5 g to 1.3 g of silver nitrate per sq.m, the silver halide grain size distribution being such that at least 50% by weight of the silver halide at both sides of the support has a mean grain size smaller than 0.55 μm.

19 Claims, 5 Drawing Figures

COLOR RADIOGRAPHY

Figure 1:
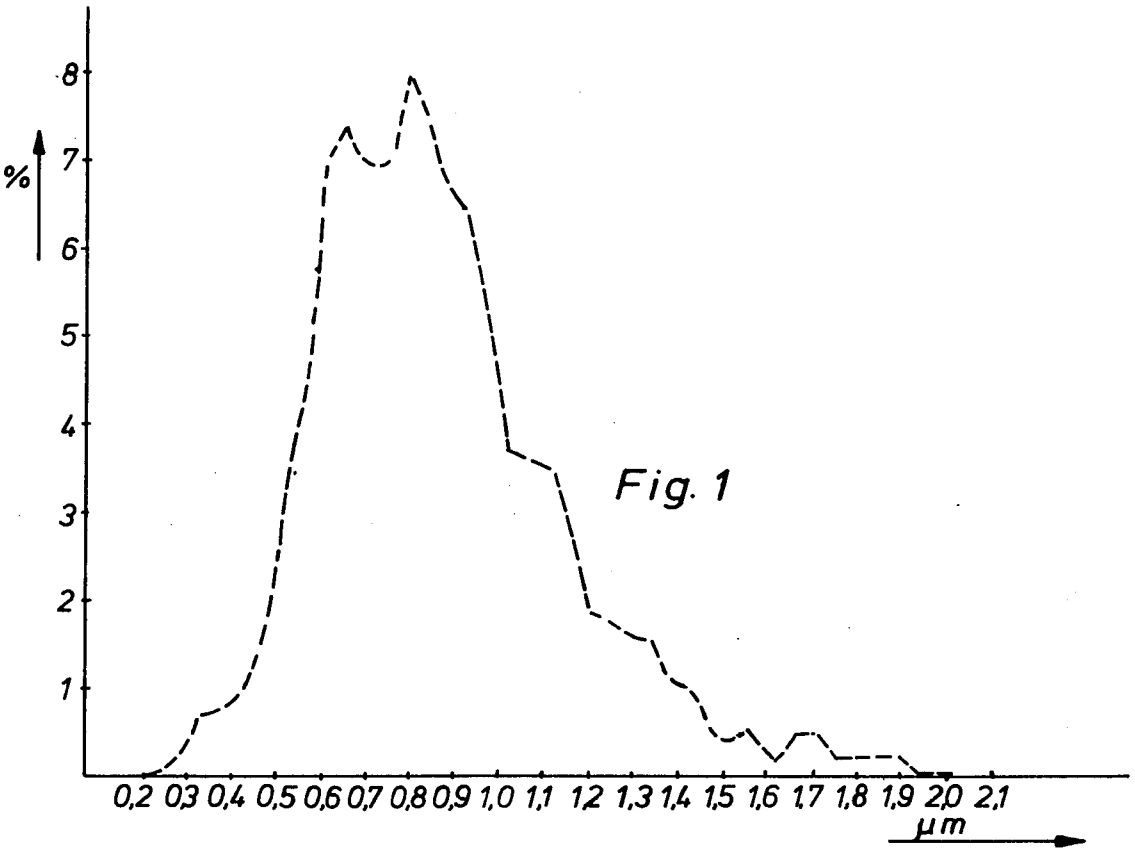

This invention relates to new radiographic recording materials and the production of radiographs with a combination of said recording materials with intensifying screens.

From the U.S. Pat. No. 3,734,735 of Jacques Elie Bories issued May 22, 1973 a radiographic process for forming a monochromatic image, optionally together with a silver image is known. The monochromatic image obtained according to said process offers an easy visual retrieval of more information than is contained in a corresponding black-and-white image.

Said process includes the following steps:

1. directly or indirectly recording penetrating radiation as (a) developable latent silver image(s) in a photographic silver halide material, which material contains at least at the the aid of the development, a substance or substances that with theaid of the exposed silver halide and possibly by reaction with (an) other substance(s) so-called oxidized colour developing agent(s) is (are) capable of forming in said material by means of one or more silver halide emulsion layers a monochromatic image mainly absorbing in two primary colour spectral regions, preferably the red and green, 2. developing the recorded latent immage(s) by means of (a) reducing substance(s) that produce(s) (a) silver image(s) together with said monochromatic image by oxidation in sity or by oxidative coupling with (a) colour coupling agent(s), so-called colour coupler(s), and 3. inspecting the obtained monochromatic image, after optional removal of the silver image(s), with white light, and optionally inspecting it with coloured light whose spectral composition is such that it is modulated by the monochromatic image, e.g. inspection with yellow or red light in case the dye image absorbs or modulates red and green light.

The silver halide materials used in said process contain an amount of silver halide equivalent to 5 to 16 g of silver nitrate per sq.m.

A silver halide content equivalent to 5 g of silver nitrate per sq.m is at the low side taking into account that for medical X-ray recording with intensifying screens normally black-and-white silver halide materials are used that contain silver halide equivalent with 13 to 14 g of silver nitrate per sq.m.

The upward trend of the cost of silver related to decreasing supplies and increased demand has put a challenge to find a solution in the direction of "low silver halide content radiographic materials" that can offer at a same or not substantially higher X-ray dose a same or even better image quality than the present high coverage silver halide materials.

An attempt in that direction has been made according to the published German Pat. Application No. 2,051,262 filed Oct. 19, 1970 by Kodak Ltd. by the use of a radiographic combination of an intensifying screen and a silver halide-containing element in which combination the screen is capable of emitting more than half of its radiant energy in the near ultraviolet region at less than about 410 nm and the silver halide is capable of producing a negative silver image in situ having a covering power greater than about 50, the silver halide being present in an equivalent concentration of less than about 8 g of silver per sq.m.

The use of photographic materials with low silver halide content brings about, however, a substantial increase of the "cross-over".

"Cross-over" is a phenomenon characteristic of a screen-film exposure using a double-side coated silver halide film material having on each side an intensifying screen emitting fluorescent light. The light emitted by one of these fluorescent screens gives rise not only to an image-wise blackening in the adjacent silver halide emulsion layer, but also penetrates to a considerale extent through the film support and produces an unsharp image in the oppositely situated sivler halide emulsion layer. The cross-over causes unsharpness because the visible light produced by the action of the X-ray beam spreads somewhat and refraction and diffuse reflection of light takes place at the boundaries of the screen layers and emulsion layers and their supports.

In medical X-ray silver halide emulsions with relatively large grain diameter (1.0 to 1.5 μm) and fairly narrow grain-size distribution have been preferred so far (see Photographic Emulsion Chemistry by G. F. Duffin — The Focal Press London and New York (1966) p. 73).

It has been established experimentally that the silver halide coverage of relatively coarse grain (average grain size about 1.2 μm) black-and-white silver halide emulsion layers used in medical X-ray materials cannot be reduced e.g. below a value smaller than the equivalent amount corresponding with about 6 g of silver nitrate per sq.m in duplitized recording materials, because the transmittance for visible light of such layers would then be so high that the "cross-over" would yield an unacceptable image sharpness.

Further it has been established that in such black-and-white materials the maximum spectral density of developed silver is too low (less than 2.00) for use in medical X-ray recording. Moreoever, the visual contrast is unacceptable.

It is an object of the present invention to provide a duplitized silver halide emulsion film with very low silver halide coverage, and particularly fast and effective developability suited for use in medical radiography with high speed intensifying screens.

It is a further object of the present invention to provide an improved radiographic combination of a pair of such fluorescent screens and a duplitized silver halide photographic material containing a very small amount of silver halide and at least at the moment of development (a) colour coupler(s) yielding on colour development of monochromatic dye image offering the possibility of contrast variation by inspection with coloured light.

The photographic material of the present invention comprises at both sides of a film support at least one silver halide emulsion layer incorporating (a) colour coupler(s) that is (are) capable of forming with an oxidized p-phenylenediamine type colour development agent (a) dye(s), said colour coupler(s) being present in an amount sufficient to allow by exposure and colour development with a p-phenylene diamine type developing agent to obtain a spectral density in the material of at least 2.0 with respect to visual filter light, the aggregate amount of silver halide in said material being equivalent to an amount of silver nitrate in the range of 5 g to 1.3 g of silver nitrate per sq.m, the silver halide grain size distribution being such that at least 50% by weight of the silver halide at both sides of the support has a mean grain size smaller than 0.55 μm, preferably in the range of 0.2 to 0.4 μm. The measurement of the spectral density with visual filter light is defined in Example 1.

In preferred photographic materials according to the present invention the emulsion layers are composed of a mixture of separately prepared emulsions in such a way that from 50 to 70% by weight of the silver halide in each layer has a mean grain size smaller than 0.55 μm, and the balance of the silver halide has a mean grain size in the range of 0.7 to 0.9 μm.

Preferred colour couplers for use according to the present invention yield on colour development a monochromatic dye image whose colour allows a good optical retrieval of information with the normal human eye.

Best optical retrieval of information with the human eye seems to be obtainable with a monochromatic dye image mainly absorbing in the red region of the visible spectrum and absorbing in the green region for at least 30% in respect of the red region. In other words cyan images with a fairly large side-absorption in the green and blue dye images are preferred.

According to a preferred embodiment the photographic material of the present invention contains a film support that is transparent for visible light and on both sides is coated with at least one silver halide emulsion layer whose silver halide grain size distribution is as described above and wherein the silver halide coverage on both sides of the support is substantially the same, each silver halide emulsion layer containing at least one colour coupler that is capable of producing on colour development with a p-phenylenediamine developing agent a dye image that absorbs mainly in the region of 700–600 nm and in the region of 600–500 nm to the extent of at least 30% of its absorption in the region of 700–600 nm and in the region of 400–500 nm at 450 nm has a spectral absorption not higher than the maximum of the absorption situated in the region of 600–500 nm.

This embodiment includes the possibility to produce a monochromatic dye image with, e.g., a colour coupler producing a magenta dye and a colour coupler producing a cyan dye.

Thus, e.g. according to an embodiment of the present invention, a photographic silver halide material is used containing two silver halide emulsion layers in one of which a cyan dye image is formed by colour development and in the other a magenta dye image corresponding to the cyan dye image, so that on visually inspecting the developed photographic material a monochromatic blue image is observed.

The use, however, of different colour couplers, each of which produces a different spectrally absorbing dyestuff, will normally ask for a higher consumption of silver halide so that where possible when the intensity and range of the spectral absorption of a dyestuff derived from only one colour coupler is satisfactory only one colour coupler instead of a mixture of colour couplers is used.

The silver halide emulsion layer(s), however, at one side of the support may have but need not have the same silver halide and/or coupler composition as the silver halide emulsion layer(s) at the opposite side. Preferably at both sides of the support colour coupler(s) are used that form dyes having substantially the same absorption spectrum.

Preferred colour couplers for use according to the present invention are phenol or α-naphthol type colour couplers that on colour development of the exposed silver halide with an aromatic primary amino developing agent form a quinonimine dye mainly absorbing in red and green and having an absorption maximum in the spectral wavelength range of 700 to 550 nm. When a mainly blue dye is produced by means of one and the same colour coupler a marked economy in silver halide consumption is obtained in respect of the use of a magenta-forming colour coupler in one silver halide emulsion layer and a cyan-forming colour coupler in another silver halide emulsion layer and in respect of the use of a mixture of a magenta-forming colour coupler and a cyan -forming colour coupler in one and the same emulsion layer.

In order to further reduce the consumption of silver halide so-called 2-equivalent couplers may be used that need only 2 instead of 4 molecules of exposed silver halide for the production of 1 dye molecule. Such couplers contain in the coupling position, e.g., a halogen atom such as iodine, bromine or chlorine (see for such type of couplers, e.g., the U.S. Pat. No. 3,006,759 of Anthony Loria, Warren A. Reckhow and Ilmari F. Salminen issued Oct. 31, 1961).

In order to obtain a high "covering power", e.g. of at least 50, the colour coupler(s) is (are) used preferably in at least 75% of the equivalent ratio "colour coupler to silver halide" necessary in the dye-forming reaction. For example the silver halide emulsions may contain an amount of colour coupler being from 1.5 to 5 times as large as the equivalent amount of silver halide.

By the term "covering power" is understood here the visual maximum optical density of the combined negative silver and colour image obtained by full development divided by the number of grams of developed silver per sq.dm. For colour couplers capable of forming an azomethine or quinonimine dye with an aromatic primary amino colour developing agent said covering power is determined after an exposure of an intensity sufficient for reaching maximum density and a full development at 41° C for 45 s in a colour developing bath as described in Example 1.

Particularly suited phenol or α-naphthol type colour couplers are those that on development of the exposed silver halide with an aromatic primary amino developing agent, e.g. of the p-phenylenediamine type, form a quinoneimine dye having its absorption maximum in the range of 570 to 660 nm.

Phenol couplers having such properties correspond, e.g., to the following general formula:

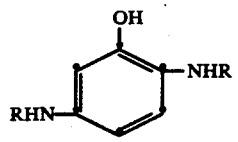

wherein: R represents a carboxylic acid acyl or sulphonic acid acyl group including said groups in substituted state, e.g. an aliphatic carboxylic acid acyl group, an aromatic carboxylic acid acyl group, an heterocyclic carboxylic acid acyl group, e.g. a 2-furoyl group or a 2-thienoyl group, an aliphatic sulphonic acid acyl group, an aromatic sulphonic acid acyl group, a sulphonyl thienyl group, an aryloxysubstituted aliphatic carboxylic acid acyl group, a phenylcarbamyl aliphatic carboxylic acid acyl group, or a tolyl carboxylic acid acyl group.

For such type of colour couplers and their preparation we refer, e.g., to the U.S. Pats. No. 2,772,162 of Ilmari F. Salminen and Charles R. Barr issued Nov. 27, 1956 and U.S. Pat. No. 3,222,176 of Jan Jaeken issued Dec. 7, 1965, and to the United Kingdom Pat. No. 975,773 filed Sept. 4, 1961 by Gevaert Photo-Producten N.V.

When known cyan-forming and magenta-forming couplers are used in separate silver halide emulsion layers and/or in admixture in one and the same silver halide emulsion layer, blue, reddish-blue to greenish-blue monochromatic images can be obtained by means of p-phenylenediamine developing agents.

For that purpose α-naphthol and phenol type couplers employed in the substractive colour photographic system for producing the cyan image, and pyrazolone, oxindole and indazolone type couplers for producing the magenta image may be applied.

The colour couplers are preferably applied in the emulsion layer(s) in diffusion-resistant state but can also be applied in dissolved state from the developing bath.

The following phenol colour couplers are especially suited for application according to the present invention.

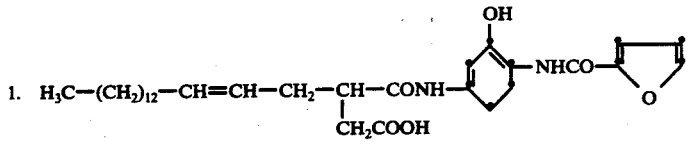

1. $H_3C-(CH_2)_{12}-CH=CH-CH_2-CH(CH_2COOH)-CONH$ (OH, NHCO)

melting point: 134° C (preparation as described in example 1 of the U.S. Pat. No. 3,734,735) mentioned before,

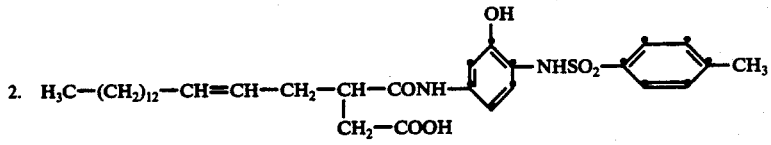

2. $H_3C-(CH_2)_{12}-CH=CH-CH_2-CH(CH_2-COOH)-CONH$ (OH, $NHSO_2$, $CH_3$)

melting point: 98° C (see preparation 3 of the U.S. Pat. No. 3,222,176) of Jan Jaeken issued Dec. 7, 1965,

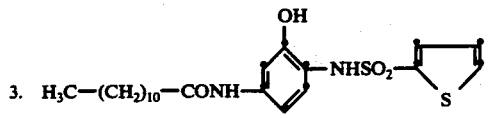

3. $H_3C-(CH_2)_{10}-CONH$ (OH, $NHSO_2$, S)

melting point: 115° C (see preparation 5 of the U.S. Pat. No. 3,222,176) mentioned above,

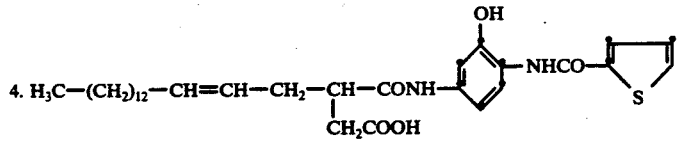

4. $H_3C-(CH_2)_{12}-CH=CH-CH_2-CH(CH_2COOH)-CONH$ (OH, NHCO, S)

melting point: 146° C (see preparation 2 of the U.K. Pat. Specification No. 975,773) filed Sept. 4, 1961 by Gevaert Photo-Production N.V.

The colour couplers 2, 3 and 4 are preferably coupled with p-phenylenediamine in order to yield a dye absorbing in the red and to a large extent absorbing in the green.

The colour coupler 1 is preferably coupled with N-hydroxy-ethyl-N-ethyl-p-phenylenediamine.

Other colour coupling systems do not necessarily involve the presence of a colour coupler and colour developing agent. Thus, according to a modified embodiment in the present invention also such colour-forming systems can be applied in which the colour coupler is partly or wholly replaced by a compound that through simple oxidation with the exposed silver halide produces a coloured substance in situ. In that respect reference is made, e.g., to P. Glafkides — Photographic chemistry Vol. II — Fountain Press — London (1960) p. 603-605. More particularly reference is made to the colour development according to Homolka, in which leuco indigo derivatives are used. For example, indoxyl and thioindoxyl are oxidized with exposed silver halide to the blue indigo and the magenta thioindigo respectively.

The colloid binder of the silver halide emulsion layers preferably consists essentially of gelatin. The weight ratio of gelatin to silver halide expressed as equivalent amount of silver nitrate is, e.g., 7:10.

The fine silver halide grains (mean grain size smaller than 0.55 μm), which form at least 50% by weight of the silver halide in the emulsion layers, have the property to render said layers highly opaque to visible light and consequently substantially diminish the cross-over. These small grains, however, are too insensitive for forming a sufficiently strong latent image when exposed with the mainly blue fluorescent light of the commonly used calcium tungstate intensifying screens that are exposed to a limited X-ray dose acceptable for producing medical X-ray radiographs without serious harm to the living body to be radiographed or blurring of the image in the case of radiographing moving objects.

The interaction of the blue fluorescent light of the intensifying screen with the small silver halide grains (smaller than 0.55 μm) produces some light-scattering in the silver halide emulsion layer adjacent to the screen. However, the light scattered in the neighbourhood of each grain does not give rise to an unacceptable loss in image sharpness and is not lost for the formation of the latent image for its is absorbed in the coarser grains (0.7 μm and more) that are substantially higher photosensitive than said smaller grains. So, when using a silver halide emulsion material of the present invention containing said silver halide grain mixture the diminution of crossover is not at the expense of a loss in photosensitivity of the silver halide emulsion layers involved but is accompanied with a gain in speed.

When a particularly good image sharpness is desired the cross-over is diminished with dyes called hereinafter "filtering dyes" absorbing light in the wavelength range emitted by the fluorescent screen but such at the cost of photographic speed.

The filtering dyes used in the silver halide emulsion recording material are preferbly incorporated in the hydrophilic colloid layer between the silver halide emulsion layers or in the emulsion layers themselves. They may, however, also be incorporated in one or more subbing layers and even in the support. The dyes may have such chemical and/or physical characteristics that they can be removed or decolourized in one of the processing baths.

According to an embodiment of the present invention filtering dyes absorbing in the wavelength range of about 400 to 500 nm are used when fluorescent screens are applied that substantially emit light in the wavelength range of 400–500 nm.

The amount of filtering dye is, e.g., 25 to 1000 mg per sq.m but smaller or larger amounts may be appropriate according to the result aimed at.

Suitable filtering dyes that can be removed in alkaline processing baths from hydrophilic colloid layers are Tartrazine and the dyes described in the U.S. Pat. No. 3,624,229 of Daniel Maurice Timmerman, August Jean Van Paesschen and Albert Emiel Van Hoof issued Nov. 30, 1971.

The spectral sensitivity of the silver halide emulsions may be enlarged or improved with common spectrally sensitizing dyes used in silver halide emulsions, which include cyanine dyes and merocyanine dyes as well as other dyes as described by F. M. Hamer in "The cyanine dyes and related compounds", Interscience Publishers (1964). These dyes are preferably used in an amount in the range of 20 mg to 250 mg per mole of silver halide.

The silver halide emulsion layers of the material of the present invention may have the same or different spectral sensitivity. According to an embodiment using green light emitting screens the silver halide emulsion layers at both sides of the support have been spectrally sensitized to green light.

The silver halide having a mean grain size below 0.55 μm, e.g. a mean diameter of 0.3 μm, originates preferably from a silver chlorobromide emulsion optionally containing up to 1 mole % of iodide. The molar ratio of chloride to bromide is, e.g. 25 to 75.

The silver halide with a mean grain size above 0.55 μm e.g. having a mean diameter of 0.7 μm, according to a preferred embodiment originates from another separately prepared emulsion that has the same halide composition as the silver halide emulsion having a mean grain size below 0.55 μm but may contain a higher iodide content, e.g. up to 5 mole % of iodide. According to another embodiment the coarser grain (mean grain size larger than 0.55 μm) emulsion contains silver bromide with an optional iodide content of 5 mole %.

The image-forming photosensitive silver halide grains may be chemically sensitized by any of the known procedures (see e.g. Photographic Emulsion Chemistry by G. F. Duffin, The Focal Press London and New York (1966) p. 83–98). The image-forming silver halide emulsions may be digested with naturally active gelatin or with small amounts of sulphur-containing compounds such as allyl thiocyanate, allylthiourea, sodium thiosulphate, etc. The image-forming emulsion may be sensitized likewise by means of reductors, e.g. tin compounds as described in the U.K. Pat. No. 789,823 filed Apr. 29, 1955 by Gevaert Photo-Producten N.V., polyamines e.g. diethyltriamine, and small amounts of noble metal compounds such as of gold, platinum, palladium, iridium, ruthenium, and rhodium as described by R. Koslowsky, Z.Wiss.Photogr.Photophys. Photochem. 46, 67–72 (1951). Representative examples of noble metal compounds are ammonium chloropalladate, potassium chloroplatinate, potassium chloroaurate and potassium aurithiocyanate.

The silver halide emulsion materials may contain in addition to the photosensitive chemically sensitized silver halide grains an amount of practically non-photosensitive silver chloride grains as described in the Belgian Pat. No. 777,581 filed Dec. 30, 1971 by the applicant (corresponding with U.S. Pat. No. 3,820,991 of Marcel Karel Van Doorselaer, Valère Frans Danckaert and Gaston Jacob Benoy issued June 28, 1974) for the purpose of speeding up the colour processing at elevated temperature (at least 30° C).

The amount of said silver chloride-containing emulsion added to the visible light-sensitive silver halide expressed in equivalent parts by weight of silver nitrate, is preferably comprised between 1:50 and 1:1. The practically non-photosensitive (i.e. non-chemically sensitized) silver chloride-containing emulsion is preferably a fine-grain silver chloride-containing emulsion having a particle size in the range from 0.05 to 0.5 μm, e.g. of a mean grain size of 0.22 μm. The sensitivity to blue light of said silver chloride emulsion is preferably 100 times as small as the blue sensitivity of the chemically sensitized silver halide emulsion.

Emulsion stabilizers and antifoggants may be added to the silver halide emulsion, e.g., the known sulphinic and selenic acids or salts thereof, aliphatic, aromatic or heterocyclic mercapto compounds or disulphides, e.g. those described and claimed in published German Pat. Application No. 2,100,622 filed Jan. 8, 1971 by Agfa-Gevaert AG, preferably comprising sulpho groups or carboxyl groups, mercury compounds e.g. those described in Belgian Pat. Nos. 524,121 filed Nov. 7, 1953 by Kodak Limited, 677,337 filed Mar. 4, 1966, 707,386 filed Dec. 1, 1967 and 709,195 filed Jan. 11, 1968 all by Gevaert-Agfa N.V., and tetra-aza-indenes as described by Birr in Z.Wiss,Photogr.Photophys. Photochem. 47, 2–58 (1952), e.g. the hydroxytetra-azaindenes of the following general formula:

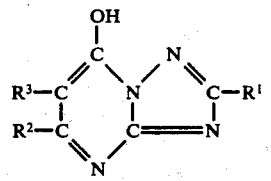

each of $R^1$ and $R^2$ represents hydrogen, an alkyl, an aralkyl, or an aryl group, and $R^3$ represents hydrogen, an alkyl, a carboxy, or an alkoxy-carbonyl group, such as 5-methyl-7-hydroxy-s-triazolo [1.5-a]-pyrimidine.

The radiation-sensitive emulsions for use in the present invention may be coated on a wide variety of transparent or semi-transparent supports e.g. films of cellulose nitrate, cellulose esters, polyvinylacetal, polystyrene, polyethylene terephthalate and other polyester materials. Said supports and/or a subbing layer thereon may contain a matting agent e.g. silica or titanium dioxide to reduce the gloss.

Preferred supports are perfectly clear and comprise a linear condensation polymer, polyethylene terephthalate being an example thereof.

The supports used in the present recording materials may be coated with subbing layers for improving the adhesion of (a) gelatino-silver halide emulsion layer(s) thereto.

The mechanical strength of melt-extruded supports of the polyester type can be improved by stretching. In some cases as described in the U.K. Pat. No. 1,234,755 filed Sept. 28, 1967 by Gevaert-Agfa N.V. the support may carry a subbing layer in the stretching stage.

Suited subbing layers are known to those skilled in the art of silver halide photography. With regard to the use of hydrophobic film supports reference is made to the composition of subbing layers described in the U.K. Pat. No. 1,234,755 mentioned before.

According to said specification a hydrophobic film support has 1) a layer directly adhering to the said hydrophobic film support and comprising a copolymer formed from 45 to 99.5% by weight of at least one of the chlorine-containing monomers vinylidene chloride and vinyl chloride, from 0.5 to 10 % by weight of at least an ethylenically unsaturated hydrophilic monomer, and from 0 to 54.5% by weight of at least one other copolymerisable ethylenically unsaturated monomer; and 2) a layer comprising in a ratio of 1:3 to 1:0.5 by weight a mixture of gelatin and copolymer of 30 to 70% by weight of butadiene with at least one copolymerisable ethylenically unsaturated monomer.

Other additives may be present in one or more of the hydrophilic colloid layers of the radiation-sensitive silver halide elements of the present invention, e.g. hardening agents such as formaldehyde, dialdehydes, hydroxyaldehydes, mucochloric and mucobromic acid, acrolein, and glyoxal, mordanting agents for anionic colour couplers or dyes formed therefrom, plasticizers and coating aids e.g. saponin and dialkylsulphosuccinic acid salts such as sodium diisooctylsulphosuccinate, alkylarylopolyether sulphuric acids, alkylarylpolyethyl ether sulphonic acids, carboxyalkylated polyethylene glycol ethers or esters as described in Franch Pat. No. 1,537,417 filed Sept. 18, 1967 by Gevaert-Agfa N.V. such as iso-$C_8H_{17}$-$C_6H_4(OCH_2CH_2)_8OCH_2COONa$, fluorinated surfactants, e.g. those described in Belgian Pat. No. 742,680 filed Dec. 5, 1969 by Gevaert-Agfa N.V. and the published German Pat. Applications Nos. 1,950,121 filed Oct. 4, 1969 by du Pont de Nemours and 1,942,665 filed Aug. 21, 1969 by Ciba AG, inert particles such as silicon dioxide, glass, starch and polymethyl methacrylate particles.

In the production of colour images together with silver images, preferably use is made of aromatic primary amino colour developing agents and derivatives thereof, e.g. N,N-diethyl-p-phenylenediamine, N-butyl-N-sulphobutyl-p-phenylenediamine, 2-amino-5-diethylaminotoluene hydrochloride, 4-amino-N-ethyl-N-(β-methane sulphonamidoethyl)-m-toluidine sesquisulphate monohydrate and N-hydroxy-ethyl-N-ethyl-p-phenylenediamine.

Preferred colour developing agents for use in combination with phenol, α-naphthol, pyrazolone and indazolone type colour couplers are N,N-dialkyl-p-phenylenediamines and derivatives thereof, e.g. N,N-diethyl-p-phenylenediamine, N-butyl-N-sulphobutyl-p-phenylenediamine, 2-amino-5-diethylaminotoluene hydrochloride and 4-amino-N-ethyl-N-(β-methane sulphonamidoethyl)-m-toluidine sesquisulphate monohydrate or N-hydroxyethyl-N-ethyl-p-phenylenediamine.

In rapid processing preferably N-butyl-N-sulphobutyl-p-phenylenediamine or N-hydroxyethyl-N-ethyl-p-phenylenediamine is used.

The colour developer can be used together with black-and-white developing agents, e.g. 1-phenyl-3-pyrazolidinone and p-monomethylaminophenol, which are known to have superadditive effect on colour development (see L. F. A. Mason, J. Phot. Sci. 11 (1963) 136–139), and other p-aminophenol derivatives, e.g. those according to French Pat. No. 1,283,420 filed Feb. 16, 1961 by Ilford Limited such as 3-methyl-4-hydroxy-N,N-diethylaniline, 3-methyl-4-hydroxy-N-ethyl-N-β-hydroxyethylaniline, 1-methyl-6-hydroxy-1,2,3,4-tetrahydroquinoline, 1-β-hydroxyethyl-6-hydroxy-1,2,3,4-tetrahydroquinoline and N-(4-hydroxy-3'-methylphenyl)-pyrrolidine.

It is also possible to use combinations of aromatic primary amino colour developing agents to obtain an increased rate of colour development (see e.g. German Pat. No. 954,311 filed Dec. 5, 1953 by Agfa AG and French Pat. No. 1,299,899 filed Sept. 8, 1961 by Agfa AG); favourable effects are obtained, e.g., by the use of N-ethyl-N-2-hydroxyethyl-p-phenylenediamine together with N-butyl-N-sulphobutyl-p-phenylenediamine, 2-amino-5-diethylamino-toluene hydrochloride or N,N-diethyl-p-phenylenediamine hydrochloride.

The developing solutions may also comprise any of the usual additional ingredients, e.g. sodium sulphite and hydroxylamino or derivatives thereof, hardening agents, antifoggants, e.g. benzotriazole, 5-nitro-benzimidazole, 5-nitro-indazole, halides such as potassium bromide, silver halide solvents, toning and intensifying compounds, solvents e.g. dimethylformamide, dimethylacetamide and N-methylpyrrolidone for chemical ingredients that are difficult to dissolve in the preparation of the developing solutions or that tend to precipitate upon standing, etc.

Development accelerators may be used either in the silver halide emulsion, in adjacent layer(s) or in the developing bath. They include alkylene oxide compounds of various types, e.g. alkylene oxide condensation products or polymers as described in U.S. Pat. No. 1,970,578 of Conrad Schoeller and Max Wittner issued Aug. 21, 1934, U.S. Pat. No. 2,240,472 of Donald R. Swan issued Apr. 29, 1941, U.S. Pat. No. 2,423,549 of Ralph Kingsley Blake, William Alexander Stanton and Ferdinand Schulze issued July 8, 1947, U.S. Pat. No. 2,441,389 of Ralph Kingsley Blake issued May 11, 1948, U.S. Pat. No. 2,531,832 of William Alexander Stanton issued Nov. 28, 1950 and U.S. Pat. No. 2,533,990 of Ralph Kingsley Blake issued Dec. 12, 1950, and in U.K. Pat. Nos. 920,637 filed May 7, 1959, 940,051 filed Nov. 1, 1961, 945,340 filed Oct. 23, 1961 all by Gevaert Photo-Production N.V. and 991,608 filed June 14, 1961 by Kodak Ltd. and 1,015,023 filed Dec. 24, 1962 by Gevaert Photo-Producten N.V. Other development accelerating compounds are onium and polyonium compounds preferably of the ammonium, phosphonium, and sulphonium type, e.g. trialkyl sulphonium salts such as dimethyl-n-nonyl sulphonium p-toluene sulphonate, tetraalkyl ammonium salts such as dodecyl trimethyl ammonium o-toluene sulphonate, alkyl pyridinium and alkyl quinolinium salts such as 1-m-nitrobenzyl quinolinium chloride and 1-dodecylpyridinium chloride, bis-alkylene pyridinium salts such as N,N'-tetramethylene bispyridinium chloride, quaternary ammonium and phosphonium polyoxyalkylene salts especially polyoxyalkylene bispyridinium salts, examples of which can be found in U.S. Pat. No. 2,944,900 of Burt H. Carroll, Hubert S. Elins, Janus L. Graham and Charles V. Wilson issued July 12, 1960, etc.

The exposed radiographic elements of the present invention are preferably processed in an automatic processing apparatus for X-ray films in which the photographic material may be guided automatically and at a constant speed from one processing unit to the other, but it will be understood by those skilled in the art that the radiographic image recording elements disclosed herein can also be processed apart from the above mentioned automatic processing apparatus in a variety of ways, such as by using the manual conventional multitank methods well known in the art.

It is self-explanatory, that, if necessary or desired, positive colour images can be produced instead of negative colour images e.g. by a known photographic colour reversal process. A preferred colour reversal process includes the steps of image-wise radiographically exposing a silver halide recording material of the present invention, developing the exposed silver halide in a black-and-white developing composition, rinsing, reexposing the recording material uniformly in order to produce a latent silver image corresponding with the initially non-irradiated silver halide, developing said latent image in a colour developing composition, optionally bleaching the silver, rinsing and drying the material.

The second exposure can be omitted if the material is treated with a solution containing a fogging agent, e.g. hydrazine or a semi-carbazide, e.g. an aqueous solution containing 10 g of semi-carbazide per litre. In a special embodiment the fogging agent is directly added to the second developer.

In the production of colour images the contrast (legibility) between the exposed parts and non-exposed parts may be improved by the production of colour images of opposite gradation and different colour. Such can proceed by the use of a photographic material containing a coloured coupler or substances, e.g. hydrazones that are used in colour masking techniques.

These hydrazones contain the following structural group:

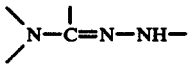

and form a dyestuff in the bleaching bath by the oxidative coupling with residual colourless colour coupler(s) which results in a dye image having a gradation opposite to that of the silver image and of the monochromatic dye image formed in the exposed parts. The colours of the images having an opposite gradation are different i.e. differ in colour tone. The application of said process in connection with radiography is described, e.g., in the U.S. Pat. No. 3,721,823 of Jan August Van Lishout and Jan Jaeken issued Mar. 20, 1973. Techniques for producing dye images with opposite gradation and ingredients for that purpose are described in the U.S. Pat. No. 3,245,797 of Jozef Frans Willems and Jan Jaeken issued Apr. 12, 1966, U.S. Pat. No. 3,245,788 of Jan Jaeken and Robert Leopold Jansseune issued Apr. 12, 1966 and U.S. Pat. No. 3,310,402 of Jan Jaeken issued Mar. 31, 1967.

A particular advantage of the recording materials of the present invention resides in the possibility of obtaining more information from the lower density portions of the colour image by inspecting it with coloured light than by inspecting it with white light. For instance, when a blue image has been produced more information can be retrieved with red light. Indeed, by the inspection with red light a higher image contrast is obtained especially in the lower density portions. In addition thereto psychometrical tests have revealed that the human eye is particularly sensitive for the perception of brightness differences in the higher density values when using white light in the blue dye image inspection (see U.S. Pat. No. 3,734,735 mentioned hereinbefore). Although a blue colour image is particularly useful in information content retrieval the present invention does not exclude the production of other colour images consisting of a dye or dyes having an absorption in one or two primary colour regions of the visible spectrum, e.g. absorption of green light or blue and red light instead of red and green light.

The inspection with coloured light can be carried out by using a coloured filter on the viewing light-box that contains a light source emitting visible light.

According to a particular embodiment the support of the silver halide emulsion layers and/or the subbing layers are coloured so that said filter on the viewing box may be omitted. When blue dye images are produced the support and/or the subbing layers have preferably a yellow colour since this much enhances the contrast of the image.

The high speed-intensifying screen materials for use in combination with photosensitive silver halide recording materials according to the present invention include a phosphor i.e. a fluorescent substance, which emits ultravolet radiation and/or visible light when struck by penetrating radiation such as X-rays, gamma-rays, beta-rays, fast electrons such as produced in an electron microscope, fast protons or neutrons.

The high speed phosphor screens that are particularly suited for use in combination with the photosensitive silver halide recording materials of the present invention have a phosphor layer, whose intensification factor is at least twice as high as that of a calcium tungstate phosphor layer having substantial identity with regard to layer thickness, binder composition, phosphor particle size and phosphor content per sq.m and has a phosphor coverage of at least 100 g per sq.m, preferably of 100 to 800 g per sq.m.

By "intensification factor" is to be understood a factor measured at a pre-elected density D, indicating the exposure required to produce this density when the film is exposed to X-rays without intensifying screen, divided by the exposure required to produce the same density, e.g. density $D=1.00$, when the film is exposed with the screen, the wavelength distribution of the X-ray radiation and the conditions of development being maintained constant.

For common medical X-ray purposes applied to the production of radiographs, e.g. of the skull, thorax and abdomen, the present silver halide recording materials are used in combination with a pair of intensifying screens so that at each silver halide layer side of the double-coated radiographic material during the X-ray exposure one screen is present. Close contact between the light-emitting surfaces of the screens and the emulsion sides of the recording material is highly desirable. For that reason each pair of screens is mounted in a cassette, which is designed to produce uniform contact between the screens and the film.

Phosphors suited for producing high speed intensifying screens of the type used in the combination of the present invention are selected from, e.g., fluorescent substances containing elements with atomic number 39 or 57 to 71, which include rare earth elements such as yttrium, gadolinium, lanthanum, cerium, etc. Particularly suitable are the rare earth oxysulphide and oxyhalide fluorescing materials activated with other selected rare earths e.g. lanthanum and gadolinium oxybromide and oxychloride activated with terbium or dysprosium, and lanthanum and gadolinium oxysulphides activated with terbium, europium, or a mixture of europium and samarium. These rare earth fluorescent materials have been extensively described in the recent literature for which we refer, e.g., to German Pat. No. 1,282,819 filed Mar. 18, 1966 by Radio Corporation of America, French Pat. Nos. 1,580,544 filed July 25, 1968 by N. V. Philips' Gloeilampenfabrieken and 2,021,397 filed Nov. 23, 1969 by General Electric, French Pat. of Addition No. 94,579 to 1,473,531 filed Mar. 24, 1966 by Radio Corporation of America, U.S. Pat. Nos. 3,546,128 of Jacob G. Rabatin issued Dec. 8, 1970 and U.S. Pat. No. 3,725,704 of Robert A. Buchanan, Melvin Tecotzky, and Kenneth A. Wickersheim issued Apr. 3, 1973 and to K. A. Wickersheim et al "Rare Earth Oxysulphide X-ray Phosphors", in the proceedings of the IEEE Nuclear Science Symposium, San Francisco, Oct. 29–31, 1969, to S. P. Wang et al. IEEE Transactions on Nuclear Science, Feb. 1970, p. 49–56, and to R. A. Buchanan IEEE Transactions on Nuclear Science, Feb. 1972, p. 81–83. These novel rare earth photoluminescent materials, especially the gadolinium and lanthanum oxysulphides and oxyhalides activated with other selected rare earths e.g. erbium, terbium or dysprosium or with terbium and dysprosium, have a high X-ray "stopping power" or average absorption and high emission density and enable radiologists to use substantially lower X-ray dosage levels.

Particularly suited phosphors for use in the fluorescent intensification screens applied in the present invention correspond to the following general formula:

$$M_{w-n}M'_nO_wX$$

wherein:

M is at least one of the metals yttrium, lanthanum, gadolinium or lutetium,

M' is at least one of the rare earth metals dysprosium, erbium, europium, holmium, neodymium, praseodymium, samarium, terbium, thulium or ytterbium, X is sulphur or halogen, $n$ is 0.0002 to 0.2, and w is 1 when X is halogen or is 2 when X is sulphur.

Another phosphor emitting in a range higher than 500 nm with emission maximum between 530 and 630 nm suited for use in a screen material of the present invention is represented by the following general formula:

$$Y_{2-x}Tb_xO_2S$$

wherein $x$ is between 0.002 and 0.2. Phosphors according to this general formula are described, e.g., in U.K. Pat. No. 1,206,198 filed Mar. 28, 1968 by U.S. Philips Corporation.

According to a preferred embodiment at least one of the fluorescent intensifying screens used in the radiographic exposure of the silver halide material contains a mixture of A. yttrium oxysulphide activated with from 0.1 to 10% by weight of terbium or activated with terbium and dysprosium, and B. gadolinium or lanthanum or lutetium oxysulphide activated with terbium or dysprosium. This mixed phosphor screen is particularly useful for its high visible light emission capacity.

A preferred ratio by weight of (A) and (B) is 25:75.

In combination with silver halide emulsion layers that are spectrally sensitized in the wavelength range of 450–570 nm preferably terbium-activated gadolinium or lanthanum oxysulphides having emission peaks at 490 and 540 nm and falling within the scope of the above general formula are used.

Other suitable intensification screens containing fluorescent materials that emit green (500–600 nm) light when exposed to cathode rays and X-ray radiations are described in U.K. Pat. No. 1,248,968 filed Dec. 4, 1968 by G.T.E. Laboratories and Corporation.

Especially suitable phosphors for use according to the present invention in an X-ray fluorescent intensifying screen-film combination are represented by the following general formula:

$$La_{w-n}\cdot Tb_n^{+3}OX$$

wherein:

X is chlorine or bromine, $w$ is 1, and $n$ is 0.006 to 0.0001.

The halogen X is preferably present in an amount of about the stoichiometric amount, but may be less e.g. only about 2.5% thereof.

Particularly strong blue light-emitting are lanthanum oxy-bromide phosphors that are activated with small amounts of terbium, e.g. with $n = 0.002$ and in which the ratio of gram atoms of oxygen to gram atoms of bromine is 1:1.

The preparation of terbium-activated lanthanum oxychloride and lanthanum oxybromide phosphors is described in the U.K. Pat. No. 1,247,602 filed Oct. 9, 1969 by General Electric Company and French Pat. Nos. 2,021,398 and 2,021,399 both filed Oct. 23, 1969 by General Electric Company, and published German Pat. Applications No. 1,952,812 filed Oct. 21, 1969 by General Electric Company and 2,161,958 filed Dec. 14, 1971 by General Electric Company.

Other particularly useful lanthanum oxyhalide phosphors for application in combination with a silver halide recording material according to the present invention are described in the published German Pat. Application No. 2,161,958 mentioned hereinbefore corresponding with the Canadian Pat. No. 927,089 filed Apr. 11, 1972 by General Electric Company. These phosphors are terbium- and ytterbium-activated lanthanum oxychlorides or lanthanum oxybromides corresponding to the following general formula:

$$La_{1-w-y}OX:Tb_wYb_y$$

wherein:

X is chlorine or bromine, $w$ is from 0.0005 to 0.006 mole per mole of the oxyhalide, and $y$ is from 0.00005 to 0.005 mole per mole of the oxyhalide.

The presence of ytterbium strongly reduces the afterglow effect that follows the X-ray irradiation so that sharper images are obtained. The preparation of this class of phosphors has been described in the published German Pat. Application No. 2,161,958 mentioned hereinbefore. Particularly interesting for the purpose of the present invention are said phosphors wherein $w$ is 0.002.

The latter Application teaches that LaOBr:Tb has an absorbing capacity for X-rays about 50% as high as calcium tungstate and an emission power in the blue light region 3 to 4 times as high as the usual calcium tungstate screens.

Another suitable lanthanum oxyhalide phosphor is a lanthanum oxychloride-fluoride phosphor as described in the published German Patent Application (DOS) No. 2,329,396 filed Jan. 2, 1975 by Siemens AG.

Still another effective phosphor for use in X-ray intensifier screens that emit in the ultraviolet and blue light region is described in the published German Patent Appl. (DOS) No. 2,404,422 filed January 30, 1974 by U.S. Atomic Energy Com. Said phosphor has the formula $Y_{1-x}Gd_xPO_4:Tb^{3+}$ wherein $x=0.3$ to 0.1 and the terbium concentration is between about 0.008 and 0.012 mole per mole of phosphate.

By using a plurality of fluorescent screen layers of different composition or by using a fluorescent screen containing a mixture of different fluorescent substances of the above general formulae a fluorescence over the whole visible spectrum can be obtained, so that such combination is particularly useful for recording with silver halide recording elements that have been made spectrally sensitive for light of the whole visible spectrum.

The fluorescent substance(s) is (are) in the form of a layer applied to a support, e.g. plastic film or cardboard, or applied as a self-supporting layer or sheet.

The thicker the fluorescent layer of the screen, the greater it its intensification. The size of the phosphor particles has also an influence in this respect: the larger the crystals, the more light they produce. Because a thick fluorescent layer and larger phosphor particles allow the light to spread more widely, the sharpness of the fluorescent image is decreased accordingly.

Suited screen layers or sheets have a thickness of preferably 0.05 to 0.5 mm and contain the fluorescent substance(s) or phosphors dispersed in a binder in an amount preferably of 80 to 95% by weight. Such binder is, e.g., an organic high molecular weight polymer. Suitable binding agents are, e.g., cellulose nitrate, ethylcellulose, celluloseacetate, polyvinyl acetate, polystyrene, polyvinyl butyral, polymethyl methacrylate and the like.

A preferred grain size of the fluorescent substances is in the range of about 1–25 μm. The phosphor coverage is preferably in the range of 100 to 800 g per sq.m.

The surface of the fluorescent material layer may be protected against moisture and mechanical damage by a coating of an organic film-forming polymer applied to a thickness of 0.001 to 0.05 mm. Such protecting coating is, e.g., a thin film of cellulose nitrate, cellulose acetate, polymethyl methacrylate and the like.

In order to improve the light output of the screen (at the expense of image sharpness) between the phosphor layer and the support, a light-reflecting layer, e.g. on the basis of titanium dioxide, may be arranged.

The following examples illustrate the present invention without, however, limiting it thereto. The percentages are by weight unless otherwise indicated.

EXAMPLE 1

A radiographic colour material I was prepared as follows:

450 g of a gelled silver halide emulsion containing 7% of gelatin and chemically sensitized (gold and sulphur sensitized) silver bromoiodide (7 mole % of silver iodide) grains in an amount of 10% expressed as equivalent silver nitrate were heated and stirred to bring it in sol form together with 50 g of a gelled practically non-photosensitive silver chloride emulsion containing 7% of gelatin and 10% of silver chloride grains expressed as equivalent silver nitrate. In the resulting emulsion mixture the mean grain size of the silver bromoiodide grains (see the grain size distribution curve in FIG. 1) and of the silver chloride grains was 0.85 and 0.22 μm respectively. The practically non-photosensitive, non-chemically sensitized silver chloride emulsion was prepared according to Example 1 of the U.S. Pat. No. 3,820,991 mentioned hereinbefore.

To the liquid silver halide emulsion mixture at 39° C 12 g of a colour coupler having the following structural formula:

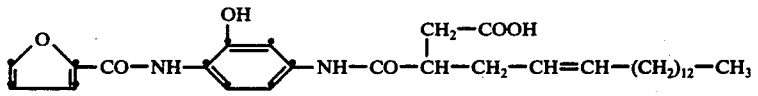

dissolved in an aqueous sodium hydroxide solution were added, whereupon 10 ml of a 1 N aqueous succinic acid solution were added to neutralize again.

Further 250 mg of 7-hydroxy-5-methyl-s-triazolo-[1,5-a] pyrimidine as stabilizer and the common hardening and wetting agents were added to reach the appropriate coating viscosity.

The resulting mixture was coated on a clear polyethylene terephthalate support having a thickness of 0.18 mm, the coating on said base being effected in such a way that each side obtained a silver halide coverage equivalent to 5 g of silver nitrate per sq.m.

Figure 2:
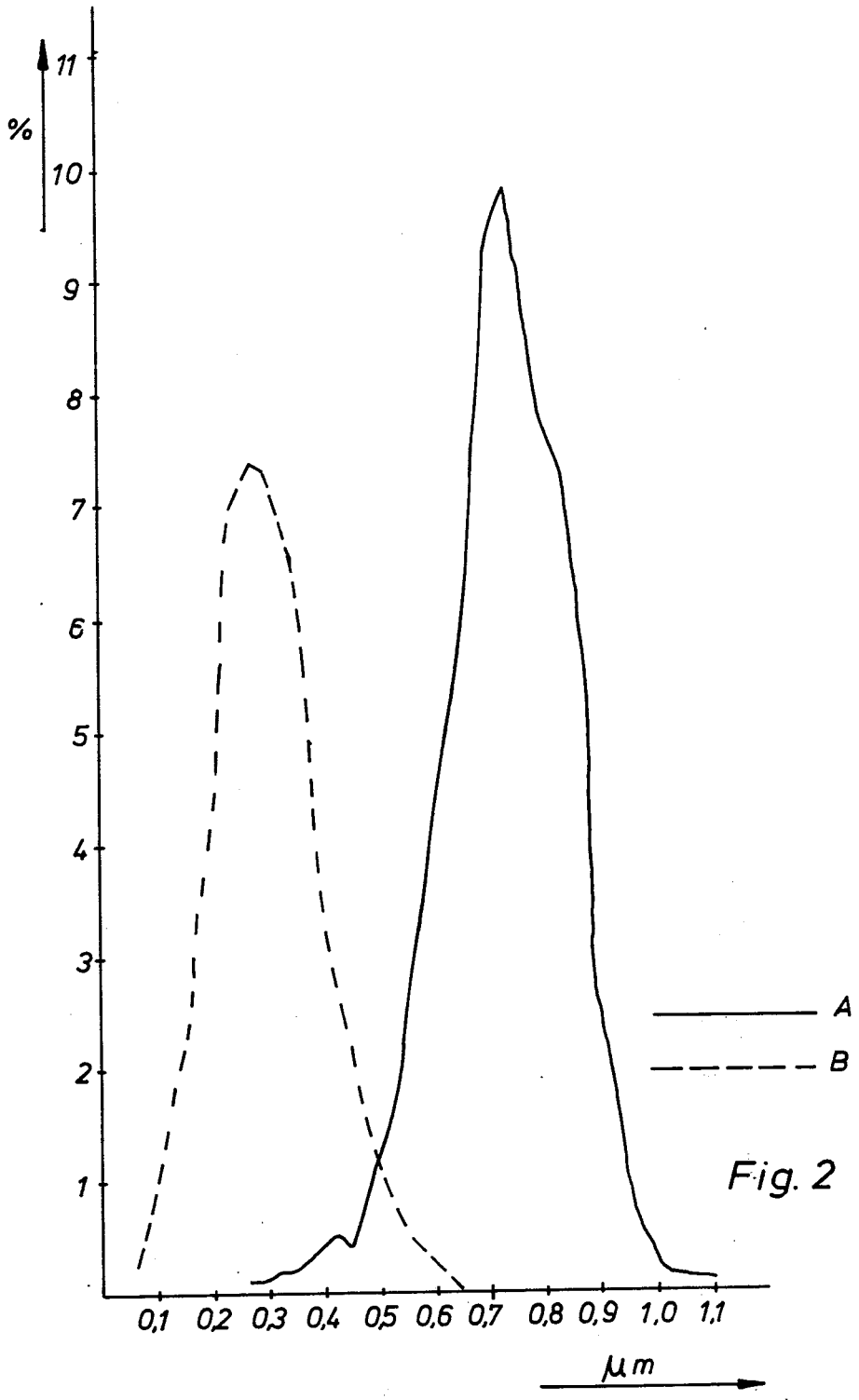

A radiographic colour material II was prepared as follows:

300 g of a 7% aqueous gelatin solution and 90 g of a gelled silver halide emulsion containing 7% of gelatin and chemically sensitized (gold and sulphur sensitized) silver chlorobromide (25 mole % of chloride) grains having a mean grain size of 0.7 μm in an amount of 10% expressed as equivalent silver nitrate were heated and stirred to bring it in sol form together with 90 g of a gelled chemically sensitized silver halide emulsion of the same halide composition (7% of gelatin and 10% of silver halide expressed as equivalent silver nitrate) but having a mean grain size of 0.3 μm and together with 20 g of a gelled practically non-photosensitive silver chloride emulsion containing 7% of gelatin and silver chloride grains (10% of silver chloride expressed as equivalent silver nitrate) of a mean grain size of 0.22 μm. The grain size distribution curve (relative grain size frequency in % versus grain diameter in μm) of the emulsion with average grain diameter 0.7 μm is given in FIG. 2 as curve A. The grain size distribution curve of the emulsion with average grain diameter 0.3 μm is given in FIG. 2 as curve B.

A same amount of colour coupler and other additives as used in the colour material I were incorporated in the emulsion mixture.

Material III was obtained by changing in the emulsion of material II the weight ratio of silver halide grains with mean grain size of 0.7 μm to silver halide grains with a mean grain size of 0.3 μm from 50:50 to 30:70.

The coating of the emulsions to obtain the materials II and III was effected in such a way that each side of the film contained an amount of silver halide equivalent to 2 g of silver nitrate per sq.m.

The radiographic colour materials were exposed to obtain a sensitometric wedge image with 80 kV X-ray radiation filtered through a 6 mm aluminium sheet.

A first sample of each material was exposed between two intensifying screens A each containing per sq.m 350 g of calcium tungstate.

A second sample of each material was exposed between two intensifying screens B each containing per sq.m 350 g of LaOBr : 0.002 Tb : 0.0005 Yb phosphor particles prepared according to the method described in the published German Pat. Specification No. 2,161,858 mentioned hereinbefore.

After exposure the samples were colour-processed automatically, which includes colour development (24 s at 41° C), fixing(20 s at 41° C), rinsing (25 s at 41° C) and drying (20 s at 55° C).

The developing bath used had a pH of 10.6 and comprised per liter:

8 g of N-hydroxyethyl-N-ethyl-p-phenylenediamine,
1.5 g of hydroxylamine,
4 g of anhydrous sodium sulphite,
1 g of potassium bromide, and
65 g of anhydrous potassium carbonate.

Fixing occurred by means of a sodium thiosulphate fixing solution.

Figure 3:
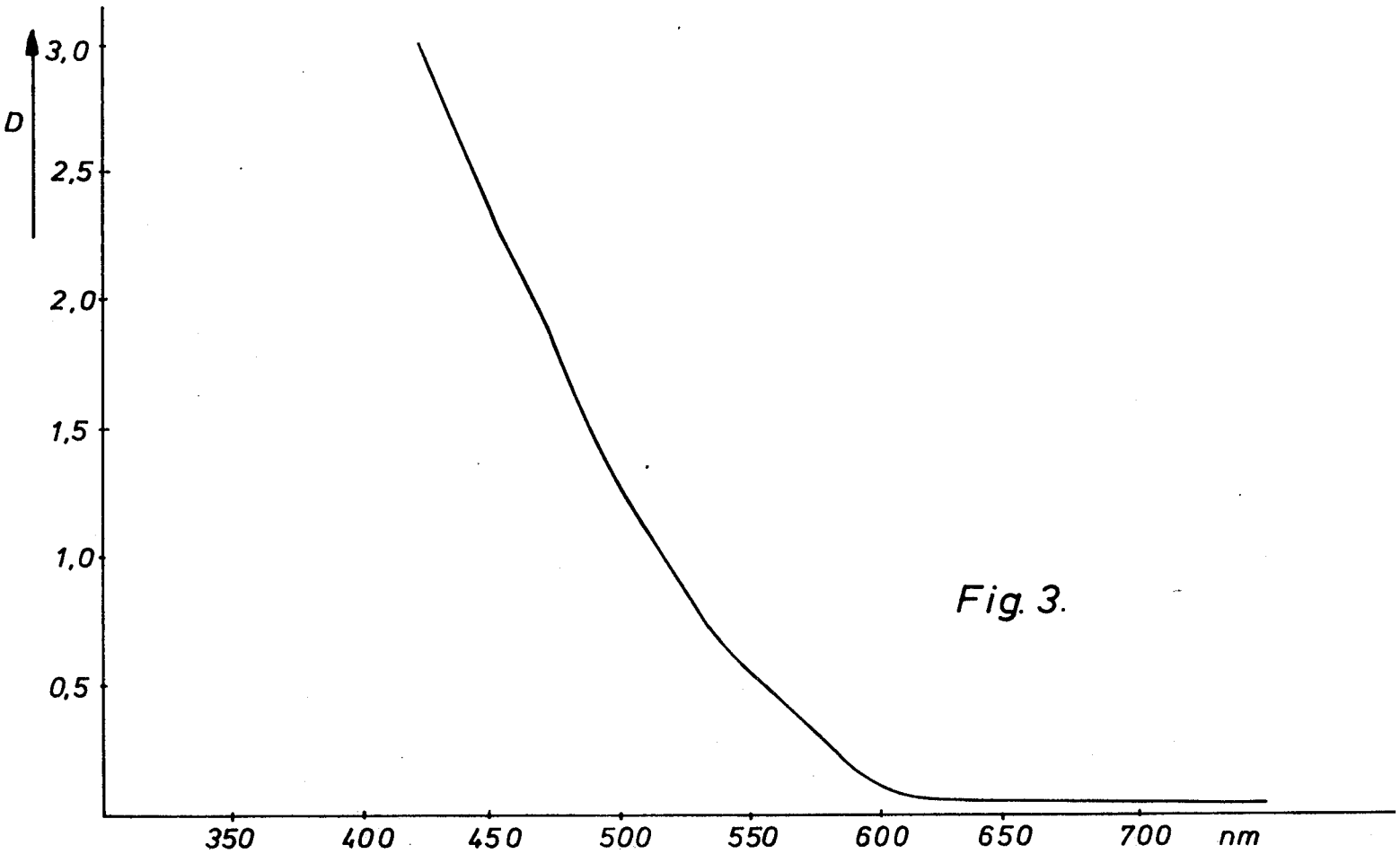

Relative speed and average gradient of the samples were determined by means of a densitometer provided with a light source of 3200° K, a S-4 response phototube and a Wratten 106 filter whereby the densities are measured with so-called "visual filter"-light i.e. having a spectral range distribution approximately characteristic for the human eye sensitivity. FIG. 3 represents the spectral density (D) versus wavelength (nm) curve of the filter used. The spectral sensitivity characteristic of a phototube having S-4 response is presented by David Mark in the book Basics of Phototubes and Photocells, John F. Rider Publisher, Inc., New York (1956) p. 46.

The following table 1 contains the measured relative speed expressed in procentual values at density 1.0 above fog and the average gradient (G) of the developed samples of radiographic colour materials I, II and III. The average gradient (G) (Δ D/Δ log E) is determined between the log E-value corresponding with the density (D) 0.2 above fog and said log E-value + 0.8 on the log E-axis of the sensitometric curve.

Table 1

| Radiographic colour material | Exposure with screens A | | Exposure with screens B | |
|---|---|---|---|---|
| | rel. speed | G | rel. speed | G |
| I | 100 | 2.05 | 400 | 2.0 |
| II | 30 | 2.46 | 120 | 2.6 |
| III | 24 | 2.55 | 100 | 2.7 |

Combined with screens B material II, which has a low silver halide content, gives better results than material I combined with the commonly used screens A.

Material III showed a considerably less "cross-over" effect and better image sharpness than material II and showed with screens B a speed still as high as that of material I in combination with screens A.

EXAMPLE 2

A radiographic colour material K of the same composition as material II of Example 1 and radiographic colour materials L, M and P, likewise of the same composition as material II of Example 1, but whose mixed silver halide emulsions were coated at a total coverage corresponding respectively with an equivalent amount of 3, 2 and 1 g of silver nitrate per sq.m were exposed with intensifying screens B and developed as described in Example 1.

The relative speed and G values of the samples were measured with light transmitted by different filters placed between the samples and the same densitometer as used in Example 1.

Figure 4:
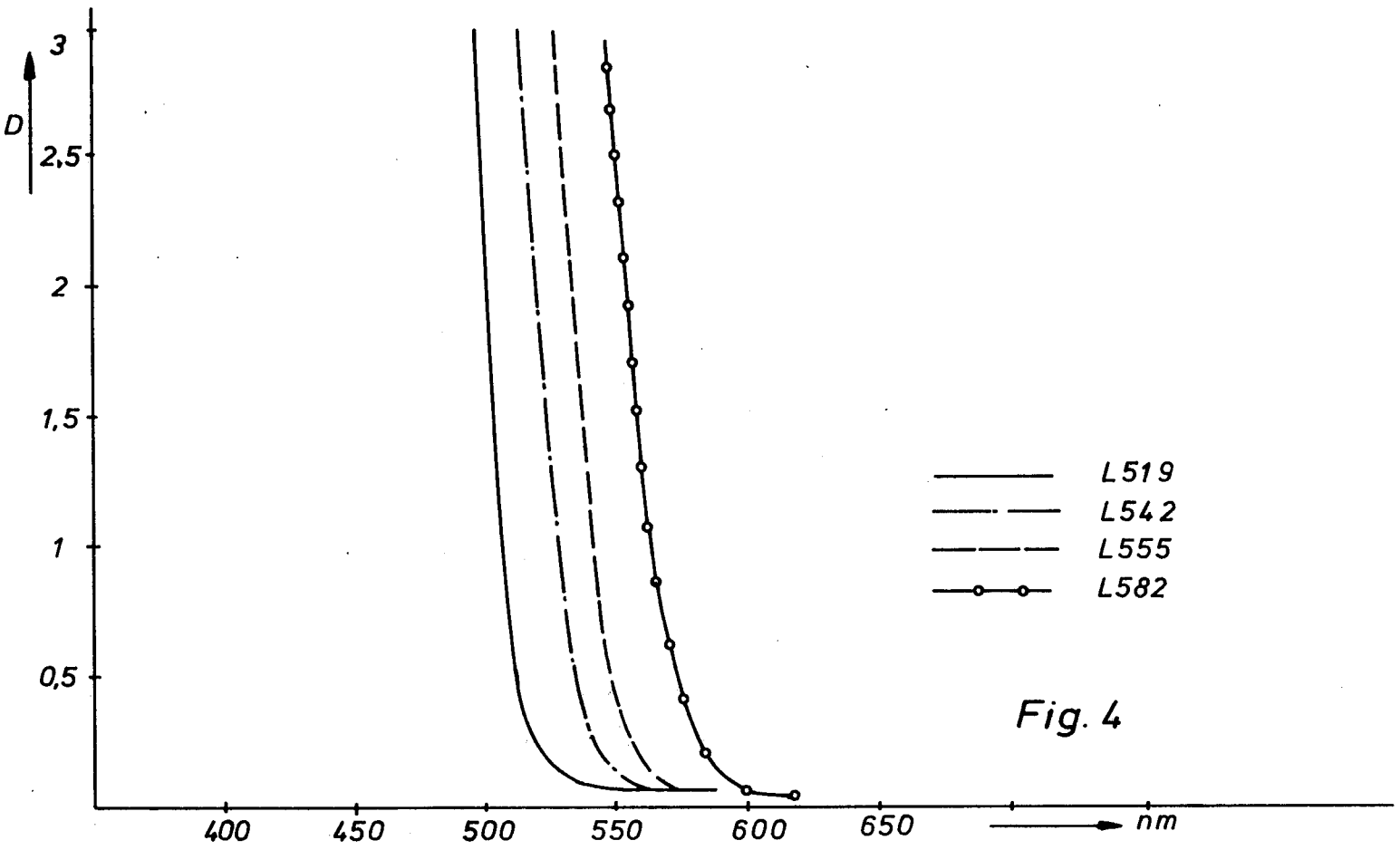

The filters used were the Agfa-Gevaert filters L 519 (yellow), L 542 (warm yellow), L 555 (orange) and L 582 (orange-red) having the density (D) versus wavelength (nm) curves given in FIG. 4.

In table 2 the maximum density values (M.D.) and average gradient (G) (see Example 1) are listed measured by using light transmitted by said filters.

In the same table 2 the maximum density values and G values are listed obtained according to the same processing procedure as described in Example 1 but by using a black-and-white developer at 35° C containing hydroquinone and 1-phenyl-3-pyrazolidinone as developing agents.

From the results listed in table 2 the following conclusions can be drawn.

1. The colour developed material L having a total silver halide coverage corresponding with an equivalent amount of 3 g of silver nitrate per sq.m yields an image with a higher gradation than material K (viewed through visual filter) having a total silver halide coverage equivalent to 4 g of silver nitrate per sq.m when viewed through filter L 519.

2. The colour developed material M having a total silver halide coverage corresponding with an equivalent amount of only 2 g of silver nitrate per sq.m yields an image with a maximum density and gradation not substantially different from those of material K (viewed through visual filter) when viewed through the filter L 582.

3. The colour-developed material N having a total silver halide coverage corresponding with an equivalent amount of only 1 g of silver nitrate per sq.m yields an image with a G value and maximum density not sufficiently high for medical radiographic purposes even when viewed through filter L 582. By interpolation it is found that radiographic colour materials of practical value in combination with screens B have to contain silver halide in an amount equivalent to at least 1.3 g of silver nitrate per sq.m.

4. When developed in a black-and-white developer none of the four samples K, L, M and P yields an image with G value and maximum density large enough for a useful X-ray picture.

Table 3

| Material | Relative speed | G value visual filter | G value L 555 |
|---|---|---|---|
| P | 117 | 2.26 | 3.10 |
| Q | 100 | 3.10 | 3.10 |

Table 2

| Radiographic colour material | Colour developed Visual filter M.D. | Visual filter G | L 519 M.D. | L 519 G | L 542 M.D. | L 542 G | L 555 M.D. | L 555 G | L 582 M.D. | L 582 G | Black-and-white developed Visual filter M.D. | Visual filter G |
|---|---|---|---|---|---|---|---|---|---|---|---|---|
| K | >3.80 | 2.46 | >3.80 | 2.94 | >3.80 | 3.22 | >3.80 | 3.52 | >3.80 | 3.72 | 1.90 | 1.27 |
| L | 3.70 | 2.40 | >3.80 | 2.85 | >3.80 | 3.15 | >3.80 | 3.30 | >3.80 | 3.60 | 1.35 | 0.81 |
| M | 3.00 | 2.09 | 3.65 | 2.50 | >3.80 | 2.67 | >3.80 | 2.85 | >3.80 | 3.12 | 0.85 | 0.64 |
| N | 1.75 | 1.31 | 2.00 | 1.52 | 2.30 | 1.66 | 2.55 | 1.82 | 2.95 | 1.96 | — | — |

EXAMPLE 3

Two radiographic silver halide materials were prepared.

The first material called material P containing an amount of silver halide equivalent to 3 g of silver nitrate per sq.m had the same composition as material L in Example 2 except for the presence of a sensitizing dye for green light. Said dye having the following structual formula:

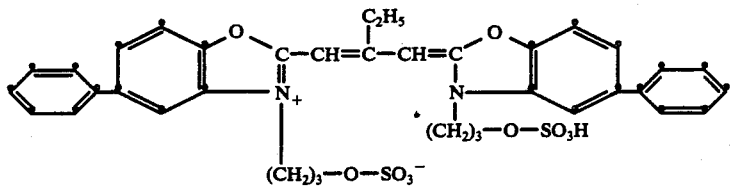

and absorbing mainly in the wavelength range of 530–550 nm was added as the first additive to the emulsion mixture in an amount of 50 mg dissolved in ethanol. The emulsion mixture was allowed to stand for 30 min before the other additives were added.

Figure 5:
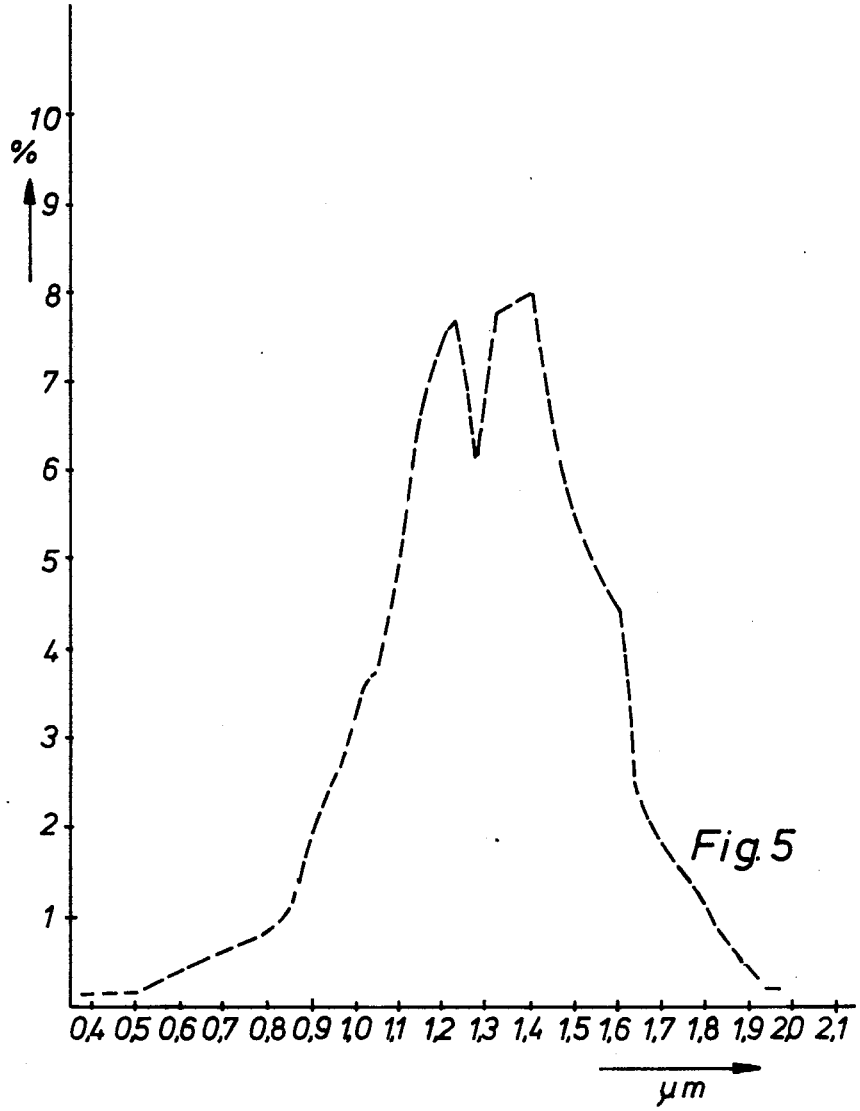

The second material called material Q containing an amount of silver halide equivalent to 14 g of silver nitrate per sq.m was a common black-and-white medical X-ray film emulsion-coated on both sides. The silver halide was chemicaly sensitized (gold and sulphur sensitized) silver bromoiodide (1.5 mole % of silver iodide) having a mean grain size of 1.2 μm. The grain size distribution curve of that material is presented in FIG. 5.

Said material contained the same additives as described in connection with material I of Example 1 except for the presence of the colour coupler.

Material P was radiographically exposed between two intensifying screens each containing per sq.m 350 g of a green light-emitting phosphor in a ratio of 75:25 consisting of a mixture of $Gd_2O_2S$ activated with 0.3 % of terbium and $Y_2O_2S$ activated with 0.3 % of terbium.

Material Q was exposed radiographically in the same way as material I of Example 1 with calcium tungstate screens. Material P was developed with the colour developer described in Example 1, whereas material Q was developed with a black-and-white developer containing hydroquinone and 1-phenyl-3-pyrazolidonone (see Example 2).

The relative speed and gradation values measured on the developed samples are listed in table 3.

As can be learned from this table 3 material P, which is a green light-senstive material containing a colour coupler and an amount of silver halide equivalent to only 3 g of silver nitrate per sq.m, offers a speed that is better than the speed obtained with the commonly used screen-film combination including material Q and calcium tungstate intensifying screens when it is combined with the intensively green light-emitting intensifying screens.

The inspection of the image obtained on material P with light transmitted by an orange filter (L 555) offers a higher G value than obtained by "visual" inspection and reaches a value equal to that obtained with the black-and-white developed material Q.

We claim:

1. A photographic material, which comprises on both sides of a film support at least one silver halide emulsion layer incorporating at least one colour coupler that is capable of forming with an oxidized p-phenylenediamine type colour developing agent a dye, said colour coupler(s) being present in an amount sufficient to allow by exposure and colour development with a p-phenylene diamine developing agent to obtain a spectral density in the material of at least 2.0 with respect to visual filter light, the aggregate amount of silver halide in said material being equivalent to an amount of silver nitrate in the range of 5 g to 1.3 g of silver nitrate per sq.m., the silver halide grain size distribution being such that at least 50% by weight of the silver halide at both sides of the support has a mean grain size smaller than 0.55 μm.

2. A photographic material according to claim 1, wherein the silver halide emulsion layers are composed of a mixture of separately prepared emulsions in such a way that from 50 to 70% by weight of the silver halide in each layer has a mean grain size in the range of 0.2 to 0.4 μm and the balance of the silver halide in each layer has a mean grain size in the range of 0.7 to 0.9 μm.

3. A photographic material according to claim 1, wherein the colour coupler(s) is (are) capable of forming a monochromatic dye image mainly absorbing in the red region of the visible spectrum and absorbing in the green region for at least 30% in respect of the red region.

4. A photographic material according to claim 3, wherein the film support is transparent to visible light and has been coated on both sides with at least one gelatin-silver halide emulsion layer containing at least one colour coupler that is capable of producing on colour development with a p-phenylene-diamine developing agent a dye image that absorbs mainly in the region of 700–600 nm and in the region of 600–500 nm to the extent of at least 30% of its absorption in the region of 700–600 nm and in the region of 400–500 nm at 450 nm has a spectral absorption not higher than the maximum of the absorption situated in the region of 600–500 nm.

5. A photographic material according to claim 1, wherein the silver halide coverage of the support is substantially the same on both sides.

6. A photographic material according to claim 1, wherein the colour coupler(s) at both sides of the support are capable of forming dyes having substantially the same light absorption spectrum.

7. A photographic material according to claim 1, wherein each of the emulsion layers contains a colour coupler according to the following general formula:

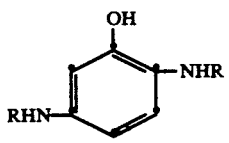

wherein:

R represents a carboxylic acid acyl or sulphonic acid acyl group including said groups in substituted form.

8. A photographic material according to claim 1, wherein the colour coupler(s) is (are) present in an amount of at least 75% of the equivalent ratio of colour coupler to silver halide necessary in the dye forming reaction.

9. A photographic material according to claim 1, wherein the silver halide having a mean grain size below 0.55 μm is a silver chlorobromide optionally containing up to 1 mole % of iodide.

10. A photographic material according to claim 1, wherein the silver halide with a mean grain size above 0.55 μm is silver bromide with an optional iodide content of 5 mole %.

11. A photographic material according to claim 1, wherein the silver halide emulsion layers contain in addition to photosensitive silver halide grains an amount of practically non-photosensitive non-chemically sensitized silver chloride grains and said silver chloride is present with respect to the photosensitive silver halide expressed in equivalent parts by weight of silver nitrate in a ratio range of 1:50 to 1:1.

12. A photographic material according to claim 11, wherein the silver chloride has a grain size in the range of 0.05 to 0.5 μm.

13. A photographic material according to any of the preceding claims, wherein the silver halide grains are spectrally sensitized with sensitizing dye.

14. A process for forming radiographs including the steps of:

arranging a photographic material, which comprises on both sides of a film support at least one silver halide emulsion layer incorporating at least one colour coupler that is capable of forming with an oxidized p-phenylenediamine type colour developing agent a dye, said colour coupler(s) being present in an amount sufficient to allow by exposure and colour development with a p-phenylene diamine developing agent to obtain a spectral density in the material of at least 2.0 with respect to visual filter light, the aggregate amount of silver halide in said material being equivalent to an amount of silver nitrate in the range of 5 g to 1.3 g of silver nitrate per sq.m, the silver halide grain size distribution being such that at least 50% by weight of the silver halide at both sides of the support has a mean grain size smaller than 0.55 μm, between two fluoroescent intensifying screens, exposing the combination of screens and photographic material to information-wise modulated penetrating radiation, and colour-developing said photographic material to form a monochromatic dye image together with a silver image, said fluorescent intensifying screens belonging to the class of screens that have a phosphor layer, whose intensification factor is at least 2 times as high as that of a calcium tungstate phosphor layer having substantial identity with regard to layer thickness, binder composition, phosphor particle size, and phosphor content per sq.m and have a phosphor coverage of at least 100 g per sq.m.

15. A process according to claim 14, wherein said intensifying screens contain as phosphor a rare earth oxysulphide or oxyhalide activated with (an) other rare earth element(s).

16. A process according to claim 15, wherein the phosphor is a lanthanum oxybromide or lanthanum oxychloride activated with terbium or dysporsium or is a lanthanum oxysulphide or gadolinium oxysulphide activated with terbium and/or dysprosium.

17. The process according to claim 14, wherein the colour development is carried out with an aromatic primary amino developing agent.

18. A process according to claim 14, wherein the information contained inthe developed photographic material is visually retrieved by inspection with white light after the formation of the monochromatic dye image and silver image.

19. A process according to claim 14, wherein after the formation of the monochromatic dye image and silver image the information contained in the developed photographic material is visually retrieved by inspection with coloured light absorbed by the dye image.

* * * * *